US011447313B2

(12) United States Patent
Blankenhorn et al.

(10) Patent No.: US 11,447,313 B2
(45) Date of Patent: Sep. 20, 2022

(54) HUMIDITY CONTROL SYSTEM

(71) Applicant: DESICCARE, INC., Las Vegas, NV (US)

(72) Inventors: Benjamin Edward Blankenhorn, Las Vegas, NV (US); Vaughn E. Fitzgerald, Henderson, NV (US); Sammie Joe Glorioso, Ridgeland, MS (US)

(73) Assignee: Desiccare, Inc., Las Vegas, NV (US)

( * ) Notice: Subject to any disclaimer, the term of this patent is extended or adjusted under 35 U.S.C. 154(b) by 0 days.

(21) Appl. No.: 17/108,997

(22) Filed: Dec. 1, 2020

(65) Prior Publication Data

US 2022/0169429 A1 Jun. 2, 2022

(51) Int. Cl.
*B65D 51/30* (2006.01)
*B65D 41/04* (2006.01)

(52) U.S. Cl.
CPC ..... *B65D 51/30* (2013.01); *B65D 41/04* (2013.01)

(58) Field of Classification Search
CPC ..... B65D 51/30; B65D 41/04; B65D 81/268; B65D 81/267; B65D 81/266; B65D 2519/0086
USPC ..... 206/204, 205, 484; 220/87.1; 215/227, 215/261
See application file for complete search history.

(56) References Cited

U.S. PATENT DOCUMENTS 1,678,939 A * 7/1928 Furber ..... B65D 51/30 215/364
2,362,796 A * 11/1944 Charlesf ..... B65D 51/30 220/521
2,758,932 A 8/1956 Scott
4,350,508 A * 9/1982 Santoro ..... B65D 51/30 96/135
4,421,235 A * 12/1983 Moriya ..... B65D 51/244 206/439
4,856,650 A * 8/1989 Inoue ..... B32B 27/12 428/137

(Continued)

FOREIGN PATENT DOCUMENTS

CL 200702758 9/2006
CL 2011002539 10/2011

(Continued)

OTHER PUBLICATIONS

Taiwan Search Report for Application No. 108121762, dated Feb. 6, 2020, 1 page.

(Continued)

*Primary Examiner* — Steven A. Reynolds
*Assistant Examiner* — Prince Pal
(74) *Attorney, Agent, or Firm* — Lewis Roca Rothgerber Christie, LLP

(57) ABSTRACT

A humidity control system includes a cap including a retention element at an inner surface of the cap, the inner surface of the cap defining an interior volume of the cap, and a package in the interior volume of the cap, the package including a humidity control substance configured to control humidity and a retainer including a sealing interface to enclose the humidity control substance, the retainer being configured to engage the retention element. The package and the inner surface of the cap define a shielded volume.

20 Claims, 5 Drawing Sheets

(56) References Cited

U.S. PATENT DOCUMENTS 5,221,000 A * 6/1993 Lee ..... A47K 5/08 215/261
5,510,166 A 4/1996 Inoue et al.
5,806,707 A * 9/1998 Boehm ..... B65D 51/28 206/217
5,813,564 A * 9/1998 Luo ..... B65D 81/268 206/204
5,934,458 A * 8/1999 Duron ..... A47J 47/10 206/204
6,250,495 B1 6/2001 Bando
6,649,086 B2 * 11/2003 Payne ..... B01D 53/28 206/0.5
6,986,807 B2 * 1/2006 Brunk ..... B65D 51/30 96/147
7,066,337 B2 * 6/2006 Hsu ..... B01D 46/0002 215/261
7,615,269 B2 * 11/2009 Payne ..... B32B 27/12 428/34.1
8,048,201 B2 11/2011 Dukes et al.
9,108,176 B2 * 8/2015 Patcheak ..... C01B 5/00
9,481,503 B2 * 11/2016 Chiang ..... B65D 51/24
9,616,381 B2 4/2017 Glorioso et al.
9,616,382 B2 * 4/2017 Glorioso ..... B01J 20/02
9,618,456 B2 4/2017 Glorioso et al.
10,081,465 B2 * 9/2018 Biesecker Longacre ..... B65D 43/162
10,279,966 B1 * 5/2019 Solomon ..... B65D 51/30
10,377,542 B2 * 8/2019 Lee ..... B65D 51/18
2003/0121418 A1 * 7/2003 Loop ..... B01D 53/261 96/135
2003/0228402 A1 12/2003 Franklin et al.
2005/0172814 A1 * 8/2005 Brunk ..... B01D 53/0415 96/108
2005/0184025 A1 * 8/2005 Hurley ..... B65D 51/30 220/521
2005/0255202 A1 11/2005 Dalziel et al.
2006/0032851 A1 * 2/2006 Hurley ..... B65D 51/30 220/23.86
2006/0144726 A1 7/2006 Foust et al.
2007/0114140 A1 * 5/2007 Portier ..... B65D 51/30 206/204
2007/0160789 A1 * 7/2007 Merical ..... B32B 27/304 206/204
2008/0047702 A1 * 2/2008 Neff ..... B65D 81/266 165/222
2009/0120931 A1 * 5/2009 Murray ..... B65D 51/165 53/396
2009/0266783 A1 * 10/2009 Eble ..... B65D 41/04 215/44
2011/0139670 A1 * 6/2011 Ciaramitaro ..... B65D 51/20 206/524.1
2011/0318232 A1 * 12/2011 Patch ..... B65D 81/266 422/129
2013/0220353 A1 8/2013 Kobayashi et al.
2014/0209488 A1 * 7/2014 Dai ..... B65D 81/264 206/204
2015/0259115 A1 * 9/2015 Yeh ..... B65D 51/30 220/521
2016/0016718 A1 * 1/2016 Berbert ..... B65D 81/3461 428/350
2018/0099797 A1 * 4/2018 Biesecker Longacre ..... B65D 51/30
2019/0031422 A1 * 1/2019 Lai ..... B65D 81/264
2019/0387779 A1 * 12/2019 Glorioso ..... B01J 20/22
2020/0062468 A1 * 2/2020 Deslauriers ..... A23L 3/0155

FOREIGN PATENT DOCUMENTS

| | | | |
|---|---|---|---|
| CN | 1207335 | | 6/2005 |
| CN | 104842607 | | 8/2015 |
| DE | 10 2007 028 467 | A1 | 12/2008 |
| EP | 0 835 685 | A1 | 4/1998 |
| EP | 3012009 | | 4/2016 |
| GB | 2161093 | | 1/1986 |
| KR | 20050013986 | A | 2/2005 |
| TW | M304449 | | 1/2007 |
| TW | 201507942 | | 3/2015 |
| WO | WO 0179341 | | 6/2005 |
| WO | WO 2006103640 | | 10/2006 |
| WO | WO 2008-037699 | A1 | 4/2008 |
| WO | WO2008/037699 | A1 | 4/2008 |
| WO | WO 2008/114905 | A1 | 9/2008 |
| WO | WO2010/120705 | A1 | 10/2010 |
| WO | WO 2010-120705 | A1 | 10/2010 |

OTHER PUBLICATIONS

"Adding Your Own Flavors to Cigars (Alternate Way)" (mikecigars.com), Jan. 28, 2017, [online], URL:https://web.archive.org/web/20170128181540/https://www.mikecigars.com/blog/adding-your-own-falvorsto-cigars/2/pg. 1.

International Search Report and Written Opinion for PCT Application No. PCT/US2019/038194, dated Sep. 13, 2019, 9 pages.

Extended European Search Report issued in corresponding EP Application No. 21211230.4-1014 dated May 10, 2022, 6 pages.

* cited by examiner

HUMIDITY CONTROL SYSTEM

BACKGROUND

1. Field

Aspects of one or more embodiments of the present disclosure relate to the field of humidity control.

2. Description of the Related Art

Humidity control products in general are known. For example, a desiccant is a hygroscopic substance that adsorbs moisture in an environment to modify a relative humidity in a particular environment. A humectant is a hygroscopic substance that absorbs moisture in an environment, which is also used to modify moisture in that environment. There are also two-way humidity control products (also called two-way humectants), such as glycerin water solutions and saturated salt solutions, which both absorb and adsorb moisture, allowing for the ambient relative humidity to be increased or decreased to a desired relative humidity.

These humidity control products may be used in various applications, such as preservation of food, herbs, pharmaceuticals and tobacco. However, to control humidity, these products tend to be placed in a container alongside the contents of the container. Such placement may expose the humidity control products to undesirable conditions which may affect the durability of the humidity control product and pose a safety risk to careless or inattentive users.

The above information disclosed in this Background section is for enhancement of understanding of the background of the present disclosure, and therefore, it may contain information that does not constitute prior art

SUMMARY

Aspects of one or more example embodiments of the present disclosure are directed towards a system for controlling humidity.

Aspects of one or more example embodiments of the present disclosure are directed towards a system for tracking and/or identifying the contents of a container including humidity control.

In one or more embodiments, a humidity control system includes a cap including a retention element at an inner surface of the cap, the inner surface of the cap defining an interior volume of the cap, and a package in the interior volume of the cap, the package including a humidity control substance configured to control humidity and a retainer including a sealing interface to enclose the humidity control substance, the retainer being configured to engage the retention element. The package and the inner surface of the cap define a shielded volume.

In one or more embodiments, the package is fixed or attached to the inner surface of the cap without using an adhesive.

In one or more embodiments, the retention element is a ridge extending circumferentially along the inner surface of the cap.

In one or more embodiments, the retainer and the retention element form a friction-fit.

In one or more embodiments, the retainer is bendable such that the retainer engages the retention element in response to the package being inserted into the interior volume of the cap.

In one or more embodiments, the package is a porous material which is permeable to vapor but is impervious to liquid, dust, and other particulates such that the shielded volume receives vapor but not liquid, dust, and other particulates in response to the package and the inner surface of the cap enclosing the shielded volume.

In one or more embodiments, the package is circular in shape with a radius of about 1 inch to an outer edge of the package, and the retainer is spaced apart from the outer edge of the package by about 0.2 inches.

In one or more embodiments, the cap includes an opaque material.

In one or more embodiments, an RFID device in the shielded volume such that the RFID device is hidden from an external viewing angle.

In one or more embodiments, the cap further includes a connection portion configured to engage a connection region of a container.

In one or more embodiments, a humidity control system includes a cap including a retention element at an inner surface of the cap, the inner surface of the cap defining a first interior volume of the cap, a package in the first interior volume of the cap, the package including a pouch and a retainer surrounding the pouch, the pouch including a humidity control substance configured to control humidity and the retainer being configured to engage the retention element, and a container defining a second interior volume. The package and the inner surface of the cap define a shielded volume spaced apart from the second interior volume of the container.

In one or more embodiments, the package is fixed or attached to the inner surface of the cap without using an adhesive.

In one or more embodiments, the retention element is a ridge extending circumferentially along the inner surface of the cap.

In one or more embodiments, the retainer and the retention element form a friction-fit.

In one or more embodiments, the retainer is bendable such that the retainer engages the retention element in response to the package being inserted into the first interior volume of the cap.

In one or more embodiments, the package is a porous material which is permeable to vapor but is impervious to liquid, dust, and other particulates such that the shielded volume receives vapor but not liquid, dust, and other particulates in response to the package and the inner surface of the cap enclosing the shielded volume.

In one or more embodiments, the package is circular in shape with a radius of about 1 inch to an outer edge of the package, and the retainer is spaced apart from the outer edge of the package by about 0.2 inches.

In one or more embodiments, the cap includes an opaque material.

In one or more embodiments, the humidity control system further includes an RFID device in the shielded volume such that the RFID device is hidden from an external viewing angle.

In one or more embodiments, the cap further includes a connection portion configured to engage a connection region of the container.

BRIEF DESCRIPTION OF THE DRAWINGS

These and other features and aspects of embodiments of the present disclosure will be better understood by reference to the following detailed description, when considered in conjunction with the accompanying drawings. The same numbers are used throughout the figures to reference like features and components. The figures are schematic in nature and may not be drawn to scale.

DETAILED DESCRIPTION

Figure 1A:
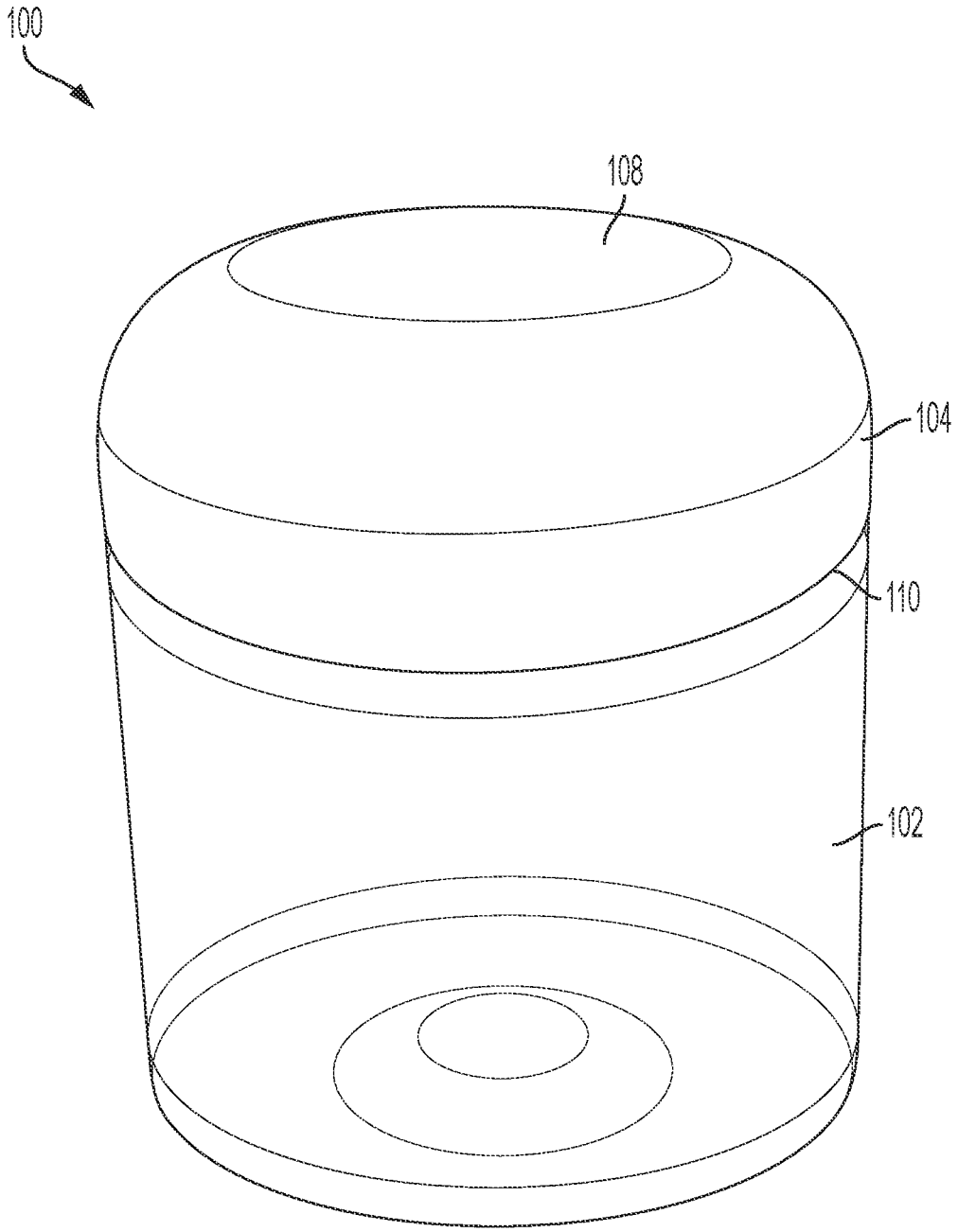
FIG. 1A is a perspective view of a humidity control system according to one or more embodiments of the present disclosure.

Hereinafter, example embodiments will be described in more detail with reference to the accompanying drawings, in which like reference numbers refer to like elements throughout. The present disclosure, however, may be embodied in various different forms, and should not be construed as being limited to only the illustrated embodiments herein. Rather, these embodiments are provided as examples so that this disclosure will be thorough and complete, and will fully convey the aspects and features of the present disclosure to those skilled in the art. Accordingly, processes, elements, and techniques that are not necessary to those having ordinary skill in the art for a complete understanding of the aspects and features of the present disclosure may not be described. Unless otherwise noted, like reference numerals denote like elements throughout the attached drawings and the written description, and thus, descriptions thereof may not be repeated.

Generally, humidity control products may be positioned inside a body of a container to directly control the humidity within the container. However, such placement may pose a danger to users, expose the humidity control device to additional sources of wear and tear, and/or cause the user to remove the humidity control product while extracting the contents of the container.

Unintentional removal or extraction of the humidity control product undermines the effectiveness of the humidity control product and may cause the humidity control product to be used in an undesirable manner. For example, a humidity control product separated from the container may present a choking hazard to a child or careless adolescent who unintentionally or unknowingly consumes the humidity control product (e.g., the humidity control product and/or components thereof).

Further, shaking the container may displace or damage the humidity control product via direct contact between the humidity control product and the contents of the container. A damaged humidity control product may less effectively control humidity and portions or components of the humidity control product may be spilled which may also present a hazard to users. Moreover, a user who carelessly empties a container may inadvertently remove the humidity control product thereby removing the source of humidity control.

According to one or more embodiments of the present disclosure, a package containing a humidity control substance is fixed within a cap of a container to protect the humidity control substance from sources of wear and tear in addition to reducing the likelihood that the humidity control substance will be inadvertently consumed or removed. The package may be provided with a set size, shape, and/or weight to provide effective humidity control while remaining fixed in the cap. In one or more embodiments, the package may be removed and replaced as desired according to a friction fit between the package and the cap without damaging the humidity control substance and without applying adhesive.

Figure 1B:
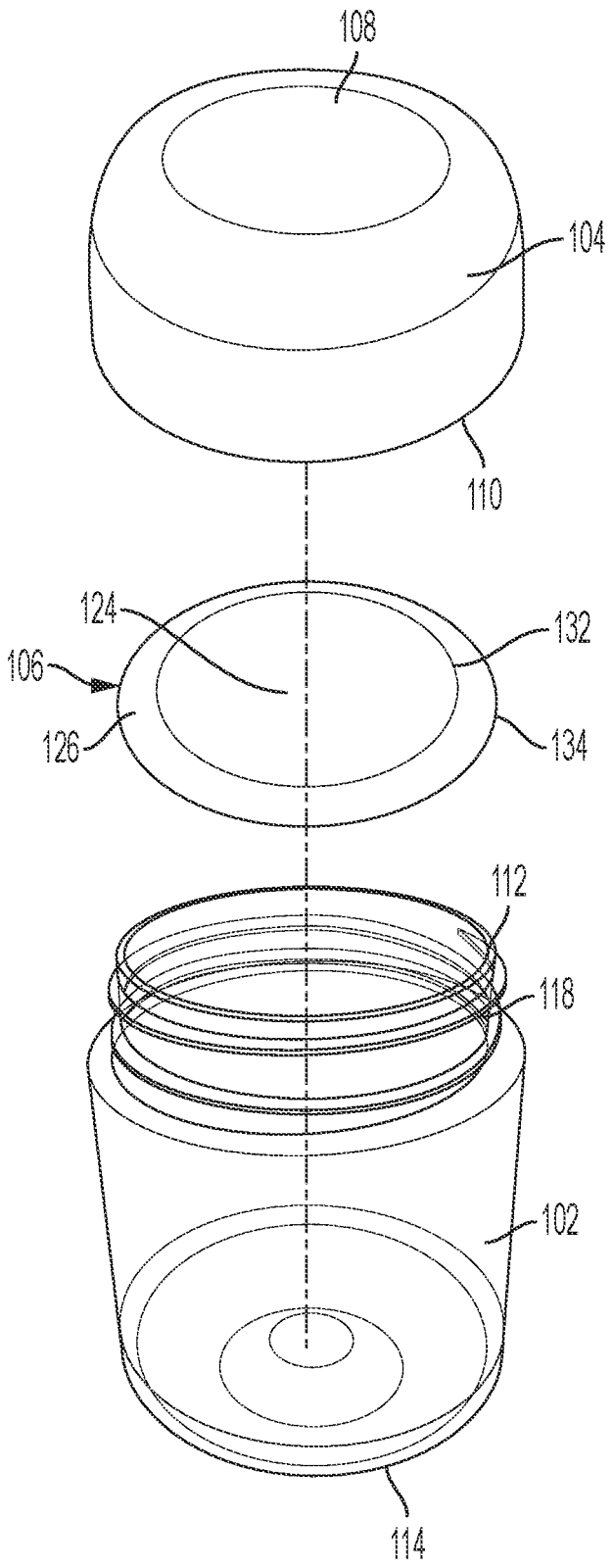
FIG. 1B is an exploded view of a humidity control system according to one or more embodiments of the present disclosure.
Figure 1C:
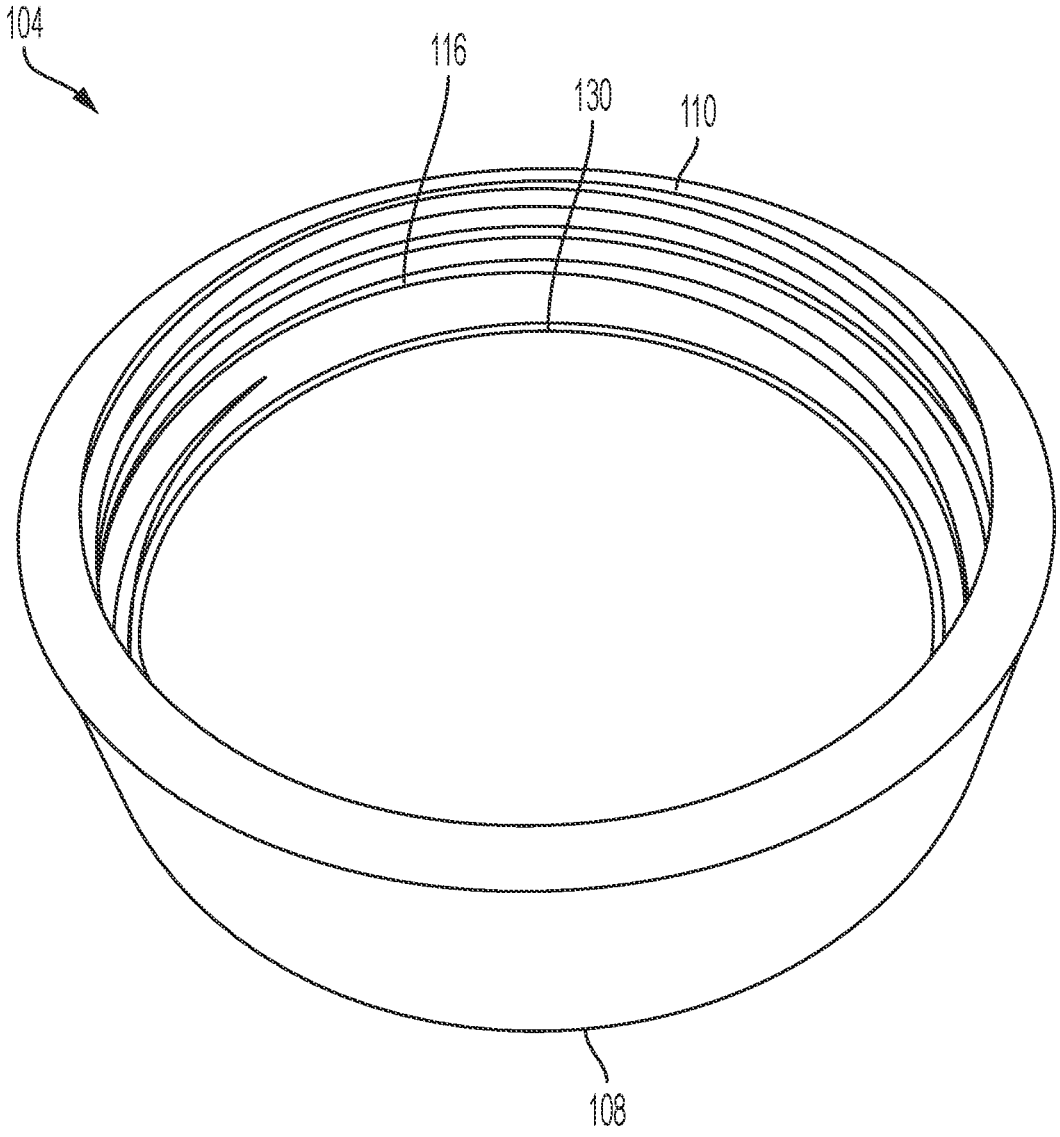
FIG. 1C is a perspective view of a cap of the humidity control system according to one or more embodiments of the present disclosure.

FIG. 1A is a perspective view of a humidity control system 100 according to one or more embodiments of the present disclosure. FIG. 1B is an exploded view of a humidity control system 100 according to one or more embodiments of the present disclosure. FIG. 1C is a perspective view of a cap 104 of the humidity control system 100 according to one or more embodiments of the present disclosure.

Referring to FIGS. 1A-1C, a humidity control system 100 includes a container 102, a cap 104 configured to engage the container 102, and a package 106. The package 106 may be filled with a humidity control substance 120 including a desiccant, an oxygen scavenger, an ethylene absorber, a one-way humectant, and/or a two-way humidity control product. In one or more embodiments, the humidity control substance 120 may include a two way humidity control product, such as a saturated salt solution or a viscous miscible glycerol (or glycerin) and water mix. Humidity control systems including a viscous miscible glycerol and water mix to provide two way humidity control are described in U.S. Pat. Nos. 9,616,381 and 9,616,382 to Desiccare, Inc., which are incorporated herein by reference in their entirety.

In one or more embodiments, the cap 104 includes a first end 108 and a second end 110 opposite to the first end 108. The container 102 includes a first end 112 and a second end 114 opposite to the first end 112. The container 102 and the cap 104 are configured to move between an open, disengaged configuration and a closed, engaged configuration. In the closed, engaged configuration, the second end 110 of the cap 104 is configured to be releasably secured or locked to the first end 112 of the container 102, and the package 106 may be between the first end 108 of the cap 104 and the second end 110 of the cap 104 such that the package 106 overlaps the interior volume of the container 102 (e.g., an interior volume defined by one or more sidewalls and a bottom of the container 102). In one or more embodiments, the package 106 may not be visible through the cap 104 to the user and may be above the interior volume of the container 102 in the closed, engaged configuration as shown in FIG. 1A. In other words, the package 106 is in a portion of the cap 104 above the container 102 in a closed configuration.

In the open, disengaged configuration, the second end 110 of the cap 104 is spaced apart or disengaged from the first end 112 of the container 102. In one or more embodiments, the package 106 may be retained between the first end 108 of the cap 104 and the second end 110 of the cap 104 such that the package 106 remains in the interior volume of the cap 104 even when the cap 104 is disengaged from the container 102.

In one or more embodiments, the cap 104 has a connection portion 116 that may be inserted into a corresponding connection region 118 of the container 102 to connect the cap 104 to the container 102. In one or more embodiments, the connection region 118 of the container 102 and/or the connection portion 116 of the cap 104 may be threaded. The connection region 118 of the container 102 may be located at or adjacent to the first end 112 of the container 102. The connection portion 116 of the cap 104 may be located at or adjacent the second end 110 of the cap 104. Therefore, the cap 104 and the container 102 may connect to each other by a threaded engagement as shown by the threads in FIGS. 1B and 1C. However, the present disclosure is not limited thereto. For example, any suitable connections between the cap 104 and the container 102 may be used such as a snap fit, friction fit, plug, or the like.

The cap 104 and the container 102 may be made of any suitable material, for example, a glass material, a metal material, or a plastic material. In one or more embodiments, the cap 104 and the container 102 are made of the same material, and in one or more embodiments, the cap 104 and the container 102 are made of different materials.

Figure 2:
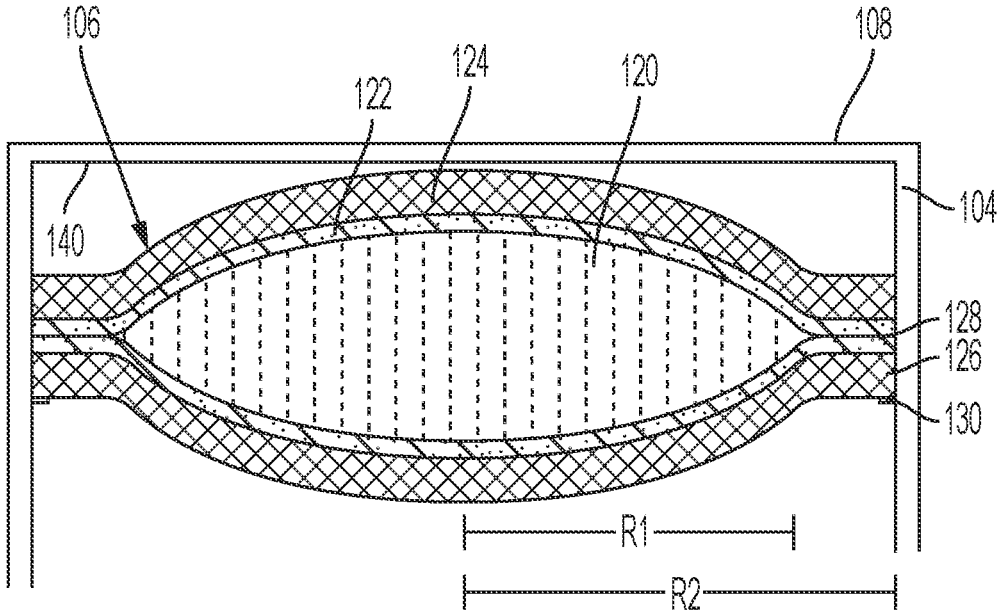
FIG. 2 is a cross-sectional view of a package and a portion of the cap according to one or more embodiments of the present disclosure.

FIG. 2 is a cross-sectional view of a package 106 and a portion of the cap 104 according to one or more embodiments of the present disclosure.

Referring to FIG. 2, in one or more embodiments, the package 106 may be positioned in the interior volume of the cap 104. The package 106 may be made of a porous material which is permeable to vapor, and will pass vapor, but is impervious to liquid, dust and other particulates. For example, in one or more embodiments, kraft paper having a basis weight of 30 lbs/msi (pounds per 1,000 square inches) or more is used for the package 106. As another example, the package 106 may be an elastomeric polyester.

In one or more embodiments, the package 106 including the humidity control substance 120 may have a circular shape with a radius R2 of about 1 inch. However, the present disclosure is not limited thereto. For example, the package 106 may have any suitable shape with suitable changes to the portion of the cap 104 receiving the package 106.

The package 106 may include a coating 122 (e.g., a microporous coating) between the package 106 and the humidity control substance 120. The coating 122 may be selected such that it provides adequate moisture vapor transmission (MVT) and seals the package 106 as described in U.S. Pat. Nos. 9,616,381 and 9,616,382 to Desiccare, Inc., which incorporated herein by reference in their entirety. In other words, the coating 122 is also used as an adhesive to join together opposing ends of the package 106. The coating 122 also reduces or minimizes the likelihood of leakage of the humidity control substance 120 through the package 106. The coating 122 may be polyethylene, oriented polystyrene, a porous polyethylene resin, polyurethane, a polyether block amide, and/or a polymeric mixture including a hydrophilic monomer. In one or more embodiments, the coating 122 may have at least a 10 lb bond so that the coating 122, and therefore the package 106, can substantially maintain their shape and retain their position once the package 106 is pressed into the cap 104 and lodged behind the first retention element 130 of the cap 104 as will be described in more detail below.

In one or more embodiments, the package 106 includes a pouch 124 including the humidity control substance 120 and a retainer 126 surrounding the pouch 124. The retainer 126 includes a sealing interface 128 between two opposing ends of the package 106. In one or more embodiments, the retainer 126 has an inner edge 132 and an outer edge 134. The inner edge 132 of the retainer 126 may form the outer edge 134 of the pouch 124 and the outer edge 134 of the retainer 126 may form the outer edge 134 of the package 106. Due to the contact between opposing ends of the package 106 at the sealing interface 128, the humidity control substance 120 remains enclosed within the pouch 124 and may not be between the inner edge 132 of the retainer 126 and the outer edge 134 of the retainer 126. Therefore, the humidity control substance 120 may not be damaged or adversely affected by flexing, bending, or folding of the retainer 126.

In one or more embodiments, the inner edge 132 and the outer edge 134 form concentric circles (as shown in FIG. 1B) and are separated from each other by a set distance (e.g., about 0.2 inches). In other words, in one or more embodiments, the retainer 126 has a width of about 0.2 inches. The inner edge 132 may have a radius R1 of about 0.8 inches from the center of the package, and the outer edge 134 may have a radius R2 of about 1 inch from the center of the package. In other words, the outer edge 134 of the pouch 124 may have a radius R1 of about 0.8 inches from the center of the package, and the outer edge 134 of the package 106 may have a radius R2 of about 1 inch from the center of the package. In one or more embodiments, the retainer 126 may have a O-shape (or ring shape) and have a thickness less than the thickness of the pouch 124 including the humidity control substance 120.

In one or more embodiments, the cap 104 and the package 106 are configured to be combined such that the package 106 remains in the interior volume (i.e., inside) the cap 104 despite gravity, shaking, and/or vibrations. In one or more embodiments, the package 106 remains in the interior volume of the cap 104 without the use of adhesive. For example, the package 106 may have a suitable weight (e.g., a low weight) for providing humidity control while having sufficient rigidity to resist gravity, shaking, and/or vibrations that may dislodge the package 106. However, the present disclosure is not limited thereto, and in other embodiments, the package 106 may be fixed or attached to the cap 104 using an adhesive or any other bonding or coupling mechanism.

In one or more embodiments, the cap 104 includes a first retention element 130 configured to interact with the retainer 126 of the package 106 to provide a friction-fit. For example, in one or more embodiments, the first retention element 130 may be a ridge adjacent to the connection region 118 of the cap 104, projecting toward the interior volume of the cap 104, and extending circumferentially along an inner surface of the cap 104.

To secure the package 106 inside the interior volume of the cap 104, the package 106 may be inserted through an opening defined by the second end 110 of the cap 104 and pushed towards the first end 108 of the cap 104. The retainer 126 may have a width (e.g., about 0.2 inches) that is greater than the first retention element 130 such that the retainer 126 instead of the pouch 124 of the package 106 overlaps with the first retention element 130. Because the retainer 126 of the package 106 may be bendable or flexible, the retainer 126 may yield to the first retention element 130 during insertion of the package 106 such that the package 106 may be inserted between the first end 108 of the cap 104 and the first retention element 130 of the cap 104. The package 106 may be inserted into the cap 104 until the package 106 contacts a second retention element 140 (e.g., an inner surface of the first end 108 of the cap 104). The package 106 may be released and gravity or any other force may lower the retainer 126 to rest on the first retention element 130 to form a friction fit thereby preventing or substantially preventing removal of the retainer 126.

To remove the package 106 from the interior volume of the cap 104, the package 106 including the pouch 124 and/or retainer 126 may be manually bent to separate the retainer 126 from the first retention element 130. Accordingly, the package 106 may be removed through the opening defined by the second end 110 of the cap 104.

In one or more embodiments, the package 106 may be inserted into the cap 104 prior to the cap 104 being placed on to the container 102 (e.g., the container 102 being a jar). Further, the cap 104 may be pre-assembled with the package 106 inside the cap 104 such that the first retention element 130 (e.g., the first retention element 130 being threads of the cap 104) holds the package 106 in the cap 104.

Figure 3:
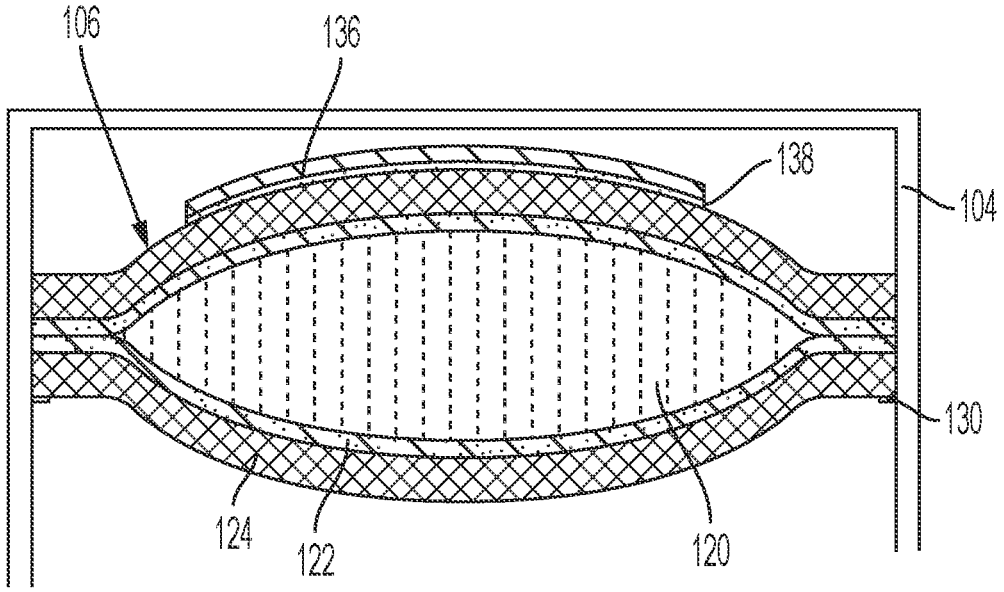
FIG. 3 is a cross-sectional view of a package and a portion of the cap according to one or more embodiments of the present disclosure.

FIG. 3 is a cross-sectional view of a package 106 and a portion of the cap 104 according to one or more embodiments of the present disclosure.

Referring to FIG. 3, in one or more embodiments, the cap 104 is made of an opaque material to prevent or substantially prevent users from viewing (e.g., viewing through the cap 104) an interior volume defined by the cap 104. In one or more embodiments, the container 102 is made of a transparent or at least translucent material to enable users to view the contents of the container 102. In this case, the interior volume defined by the cap 104 may be partially visible depending on the viewing angle of the user. For example, unless blocked by another material (e.g., an opaque material), a user may view the interior volume of the cap 104 through the bottom of a transparent or translucent container 102 but not through the cap 104 itself.

In one or more embodiments, the package 106 may be positioned such that the package 106 blocks the view (e.g., the view through a transparent or translucent container 102) of security items such as a radio frequency identification device (RFID) 136. In other words, the RFID device 136 may be positioned in the interior volume of the cap 104 between the package 106 and the first end 108 of the cap 104. Therefore, the RFID device 136 may be enclosed or surrounded by the package 106 and the cap 104. In this case, a user may be prevented or substantially prevented from viewing the RFID device 136. In other words, the RFID device 136 may be hidden from an external viewing angle. Accordingly, the RFID device 136 may be used for security and/or inventory tracking without a user's awareness. Information about the container 102 and its contents may be provided via the RFID device 136 to an administrative agency, an owner, and/or authorities in order to satisfy regulatory control requirements.

In one or more embodiments, the RFID device 136 may be adhered to a surface of the package. The RFID device 136 may be affixed or adhered to the package directly or indirectly by an adhesive 138. The adhesive 138 may be any suitable adhesive, including glue, single-sided tape, double-side tape, and/or adhesive backing. The adhesive 138 may be applied to effectively form a seal between the RFID device 136 and the package, thereby preventing any substances from entering a space between the RFID device 136 and the package after they are adhered to each other. Therefore, the adhesive 138 may serve as a barrier between the RFID device 136 and the package (and the humidity control substance contained therein). By affixing the RFID device 136 to the package, directly or indirectly, the RFID device 136 is less likely to be tampered with because removing the RFID device 136 may damage the package which controls the humidity inside the container.

Due to the properties of the package 106 and the cap 104, the portion of the interior volume of the cap 104 defined by or enclosed by the cap 104 (e.g., a portion of the inner surface of the cap 104) and the package 106 may provide a shielded volume protected against liquid, dust and/or other particulates. In other words, liquid, dust, and/or other particulates inside the container 102 may be blocked or substantially blocked by the package 106 and liquid, dust, and/or other particulates from outside the container 102 may be blocked by the cap 104. Therefore, one or more items (e.g., the RFID device 136) enclosed by the cap 104 and the package 106 may be protected or substantially protected from liquid, dust and/or other particulates.

Accordingly, as disclosed herein, embodiments of the present disclosure provide a humidity control system including improved protection for a humidity control substance and enhanced safety features. Further, the humidity control system may provide additional protection regions for concealing and/or protecting components such as security, tracking, monitoring, and/or tracing devices.

In the drawings, the relative sizes of elements, layers, and regions may be exaggerated and/or simplified for clarity.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments and is not intended to be limiting of the present disclosure. As used herein, the singular forms "a" and "an" are intended to include the plural forms as well, unless the context clearly indicates otherwise. It will be further understood that the terms "comprises," "comprising," "includes," and "including," "has," "have," and "having," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Further, the use of "may" when describing embodiments of the present disclosure refers to "one or more embodiments of the present disclosure."

As used herein, the terms "substantially", "about", and similar terms are used as terms of approximation and not as terms of degree, and are intended to account for the inherent deviations in measured or calculated values that would be recognized by those of ordinary skill in the art.

Unless otherwise defined, all terms (including technical and scientific terms) used herein have the same meaning as commonly understood by one of ordinary skill in the art to which the present disclosure belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

While this disclosure has been described in detail with particular references to some exemplary embodiments thereof, the exemplary embodiments described herein are not intended to be exhaustive or to limit the scope of the disclosure to the exact forms disclosed. It is understood that the drawings are not necessarily to scale. Persons skilled in the art and technology to which this disclosure pertains will appreciate that alterations and changes in the described structures and methods of assembly and operation can be practiced without meaningfully departing from the principles, spirit, and scope of this disclosure, as set forth in the following claims and their equivalents.

What is claimed is:

1. A humidity control system comprising:

a cap comprising a retention element at an inner surface of the cap, the inner surface of the cap defining an interior volume of the cap; and a package in the interior volume of the cap, the package comprising a humidity control substance configured to control humidity and a retainer comprising a sealing interface to enclose the humidity control substance, the retainer being configured to engage the retention element, wherein an outer upper surface of the package and the inner surface of the cap define a shielded volume, wherein the package is a porous material which is permeable to vapor but is impervious to liquid, dust, and other particulates such that the shielded volume receives vapor but not liquid, dust, and other particulates in response to the package and the inner surface of the cap enclosing the shielded volume, and wherein the retainer is bendable such that the retainer engages the retention element in response to the package being inserted into the interior volume of the cap.

2. The humidity control system of claim 1, wherein the package is fixed or attached to the inner surface of the cap without using an adhesive.

3. The humidity control system of claim 1, wherein the retention element is a ridge extending circumferentially along the inner surface of the cap.

4. The humidity control system of claim 1, wherein the retainer and the retention element form a friction-fit.

5. The humidity control system of claim 1, wherein the package is circular in shape with a radius of about 1 inch to an outer edge of the package, and wherein the retainer is spaced apart from the outer edge of the package by about 0.2 inches.

6. The humidity control system of claim 1, wherein the cap comprises an opaque material.

7. The humidity control system of claim 6, further comprising an RFID device in the shielded volume such that the RFID device is hidden from an external viewing angle.

8. The humidity control system of claim 1, wherein the cap further comprises a connection portion configured to engage a connection region of a container.

9. A humidity control system comprising:

a cap comprising a retention element at an inner surface of the cap, the inner surface of the cap defining a first interior volume of the cap;

a package in the first interior volume of the cap, the package comprising a pouch and a retainer surrounding the pouch, the pouch comprising a humidity control substance configured to control humidity and the retainer being configured to engage the retention element; and a container defining a second interior volume, wherein an outer upper surface of the package and the inner surface of the cap define a shielded volume spaced apart from the second interior volume of the container, the shielded volume being adapted to receive contents other than the humidity control substance, and wherein the retainer is bendable such that the retainer engages the retention element in response to the package being inserted into the first interior volume of the cap.

10. The humidity control system of claim 9, wherein the package is fixed or attached to the inner surface of the cap without using an adhesive.

11. The humidity control system of claim 9, wherein the retention element is a ridge extending circumferentially along the inner surface of the cap.

12. The humidity control system of claim 9, wherein the retainer and the retention element form a friction-fit.

13. The humidity control system of claim 9, wherein the package is a porous material which is permeable to vapor but is impervious to liquid, dust, and other particulates such that the shielded volume receives vapor but not liquid, dust, and other particulates in response to the package and the inner surface of the cap enclosing the shielded volume.

14. The humidity control system of claim 9, wherein the package is circular in shape with a radius of about 1 inch to an outer edge of the package, and wherein the retainer is spaced apart from the outer edge of the package by about 0.2 inches.

15. The humidity control system of claim 9, wherein the cap comprises an opaque material.

16. The humidity control system of claim 15, further comprising an RFID device in the shielded volume such that the RFID device is hidden from an external viewing angle.

17. The humidity control system of claim 9, wherein the cap further comprises a connection portion configured to engage a connection region of the container.

18. The humidity control system of claim 1, wherein the package is bendable such that the package is configured to be selectively removed from the cap.

19. A humidity control system comprising:

a cap comprising a retention element at an inner surface of the cap, the inner surface of the cap defining an interior volume of the cap; and a package in the interior volume of the cap, the package comprising a humidity control substance configured to control humidity and a retainer comprising a sealing interface to enclose the humidity control substance, the retainer being configured to engage the retention element, wherein an outer upper surface of the package and the inner surface of the cap define a shielded volume, and wherein the retainer is bendable such that the retainer engages the retention element in response to the package being inserted into the interior volume of the cap.

20. The humidity control system of claim 19, wherein the retainer and the retention element form a friction-fit.

* * * * *